US009905145B2

(12) United States Patent
Wang et al.

(10) Patent No.: US 9,905,145 B2
(45) Date of Patent: Feb. 27, 2018

(54) PIXEL STRUCTURE, ITS DRIVING METHOD AND DISPLAY DEVICE

(71) Applicant: BOE TECHNOLOGY GROUP CO., LTD., Beijing (CN)

(72) Inventors: Hongli Wang, Beijing (CN); Renwei Guo, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/763,096

(22) PCT Filed: Feb. 3, 2015

(86) PCT No.: PCT/CN2015/072141
§ 371 (c)(1),
(2) Date: Jul. 23, 2015

(87) PCT Pub. No.: WO2016/070502
PCT Pub. Date: May 12, 2016

(65) Prior Publication Data

US 2016/0343282 A1 Nov. 24, 2016

(30) Foreign Application Priority Data

Nov. 4, 2014 (CN) ..... 2014 1 0613079

(51) Int. Cl.
*G09G 3/20* (2006.01)

(52) U.S. Cl.
CPC ..... *G09G 3/2003* (2013.01); *G09G 3/2096* (2013.01); *G09G 2300/0426* (2013.01);
(Continued)

(58) Field of Classification Search
None
See application file for complete search history.

(56) References Cited

U.S. PATENT DOCUMENTS

2005/0078109 A1* 4/2005 Mori ..... G06T 17/20 345/419
2005/0270444 A1 12/2005 Miller et al.
(Continued)

FOREIGN PATENT DOCUMENTS

CN 1551383 A 12/2004
CN 102262854 A 11/2011
(Continued)

OTHER PUBLICATIONS

International Search Report and Written Opinion dated May 27, 2015 regarding PCT/CN2015/072141. Translation provided by Dragon Intellectual Property Law Firm.
(Continued)

*Primary Examiner* — Jennifer Mehmood
*Assistant Examiner* — Parul Gupta
(74) *Attorney, Agent, or Firm* — Harness, Dickey & Pierce, P.L.C.

(57) ABSTRACT

The present disclosure provides a pixel structure, its driving method and a display device. The pixel structure comprises a plurality of repeating units consisting of subpixels. Each repeating unit comprises four subpixels in different colors, which are divided into two groups. Each group of subpixels includes a subpixel with its major-axis direction as a first direction and a subpixel with its major-axis as a second direction perpendicular to the first direction.

23 Claims, 17 Drawing Sheets

(52) U.S. Cl.
CPC ..... *G09G 2300/0452* (2013.01); *G09G 2300/0465* (2013.01); *G09G 2320/0242* (2013.01)

(56) References Cited

U.S. PATENT DOCUMENTS

| | | | | |
|---|---|---|---|---|
| 2006/0033422 | A1 | 2/2006 | Chao et al. | |
| 2010/0118045 | A1* | 5/2010 | Brown Elliott .... | G02B 27/2214 345/589 |
| 2011/0260951 | A1* | 10/2011 | Hwang ..... | G02F 1/134336 345/55 |
| 2011/0260952 | A1 | 10/2011 | Hwang et al. | |
| 2014/0204008 | A1* | 7/2014 | Chu-Ke ..... | G09G 3/2003 345/88 |

FOREIGN PATENT DOCUMENTS

| | | | |
|---|---|---|---|
| CN | 102903318 | A | 1/2013 |
| CN | 103545344 | A | 1/2014 |
| CN | 103714751 | A | 4/2014 |
| CN | 103928496 | A | 7/2014 |
| CN | 104036701 | A | 9/2014 |
| CN | 204102504 | U | 1/2015 |
| EP | 0330361 | A2 | 8/1989 |

OTHER PUBLICATIONS

Second Office Action regarding Chinese application No. 201410613079.5, dated Dec. 28, 2016. Translation provided by Dragon Intellectual Property Law Firm.

* cited by examiner

PIXEL STRUCTURE, ITS DRIVING METHOD AND DISPLAY DEVICE

CROSS-REFERENCE TO RELATED APPLICATION

The present application is the U.S. national phase of PCT Application No. PCT/CN2015/072141 filed on Feb. 3, 2015, which claims a priority of the Chinese patent application No. 201410613079.5 filed on Nov. 4, 2014, which is incorporated herein by reference in its entirety.

TECHNICAL FIELD

The present disclosure relates to the field of display technology, in particular to a pixel structure, its driving method and a display device.

BACKGROUND

For an existing display panel, a pixel unit, as a common pixel design, includes three subpixels (i.e., a red subpixel, a green subpixel and a blue subpixel) or four subpixels (i.e., a red subpixel, a green subpixel, a blue subpixel and a white subpixel) for display, and a physical resolution is just a visual resolution.

Along with an increase in the user's experience on the display panel (i.e., an increase in the requirements on the visual resolution), it is required to increase a pixel per inch (PPI) of the display panel. However, an increase in the PPI will result in a complex process for manufacturing the display panel.

Hence, there is an urgent need in the art to increase the visual resolution without increasing the difficulty in manufacturing the display panel.

SUMMARY

An object of the present disclosure is to provide a pixel structure, its driving method and a display device, so as to increase a visual resolution without increasing the difficulty in manufacturing the display device.

In one aspect, the present disclosure provides in one embodiment a pixel structure, including a plurality of repeating units consisting of subpixels. Each repeating unit includes four subpixels in different colors, which are divided into two groups. Each group of subpixels includes a subpixel with its major-axis direction as a first direction and a subpixel with its major-axis as a second direction perpendicular to the first direction.

Alternatively, the first direction is a row direction, and the second direction is a column direction.

Alternatively, the subpixel is of a quadrilateral shape.

Alternatively, the two subpixels in each group of subpixels are each of an L shape and a mirror image of L and arranged in such a manner as to be rotated by 0°, 45°, 90°, 135° or 180° in a clockwise or counterclockwise direction.

Alternatively, in each repeating unit, the two subpixels with their major-axis direction as the first direction are arranged in adjacent rows, and the two subpixels with their major-axis direction as the first direction are staggered relative to each other in the column direction by a predetermined distance.

Alternatively, in each repeating unit, the two subpixels with their major-axis direction as the second direction are adjacent to the two subpixels with their major-axis direction as the first direction, and the two subpixels with their major-axis direction as the second direction are not adjacent to each other.

Alternatively, in the two groups of subpixels in each repeating unit, the two subpixels with their major-axis direction as the second direction are arranged in adjacent columns, and the two subpixels with their major-axis direction as the second direction are staggered relative to each other in the row direction by a predetermined distance.

Alternatively, in each repeating unit, the two subpixels with their major-axis direction as the first direction are adjacent to the two subpixels with their major-axis direction as the second direction, and the two subpixels with their major-axis direction as the first direction are not adjacent to each other.

Alternatively, a length of each subpixel in the major-axis direction and a length of the subpixel in a minor-axis direction meet $2S<L<3S$, wherein S represents the length of the subpixel in the minor-axis direction, and L represents the length of the subpixel in the major-axis direction.

Alternatively, the plurality of repeating units are arranged repeatedly in a third direction which is a direction rotated in a counterclockwise direction by 45° relative to the row direction, or a direction rotated in the counterclockwise direction by 45° relative to the column direction.

Alternatively, the subpixels with their major-axis direction as the first direction are arranged sequentially in the third direction, and the subpixels with their major-axis direction as the second direction are also arranged sequentially in the third direction.

Alternatively, the subpixels with their major-axis direction as the first direction include subpixels in a first color and subpixels in a second color, the subpixels with their major-axis direction as the second direction include subpixels in a third color and subpixels in a fourth color, the subpixels in the first color and the second color are arranged alternately in the third direction, and the subpixels in the third color and the fourth color are arranged alternately in the third direction.

Alternatively, the subpixels in four different colors include three subpixels in primitive colors and one subpixel in a complementary color, the subpixels in the primitive colors include a red subpixel, a green subpixel and a blue subpixel, and the subpixel in the complementary color includes a white subpixel, a magenta subpixel, a cyan subpixel, a yellow subpixel or a garnet subpixel.

In another aspect, the present disclosure provides in one embodiment a display device including the above-mentioned pixel structure and a device for driving the pixel structure.

In yet another aspect, the present disclosure provides in one embodiment a method for driving the above-mentioned pixel structure, including steps of:

causing a desired color component of a primitive color to be displayed at each subpixel position, including causing a plurality of subpixels in an identical primitive color in proximity to the subpixel position to display together, and causing the desired color component to be displayed at the subpixel position under an average effect of the plurality of subpixels in the identical primitive color; and performing display compensation at the subpixel position, including performing the display compensation at the subpixel position under an average effect of a plurality of subpixels in a complementary color in proximity to the subpixel position.

Alternatively, when a color component of a primitive color identical to a color of a subpixel at a subpixel position is desired to be displayed at the subpixel position, the plurality of subpixels in the identical primitive color in proximity to the subpixel position includes the subpixel at the subpixel position and a plurality of subpixels in the identical primitive color surrounding the subpixel position. When a color component of a primitive color different from a color of a subpixel at a subpixel position is desired to be displayed at the subpixel position, the plurality of subpixels in the identical primitive color in proximity to the subpixel position includes a plurality of subpixels in a primitive color identical to the to-be-displayed color component surrounding the subpixel position.

Alternatively, when a color component of a primitive color identical to a color of a subpixel at a subpixel position is desired to be displayed at the subpixel position, the plurality of subpixels in the identical primitive color in proximity to the subpixel position includes:

eight subpixels in the primitive color identical to the color of the subpixel at the subpixel position in closest proximity to the subpixel position, which are arranged at both sides of a row in which the subpixel position is located, and in the upper three rows and the lower three rows adjacent to the row in which the subpixel position is located, and which form a parallelogram; or eight subpixels in the primitive color identical to the color of the subpixel at the subpixel position in closest proximity to the subpixel position, which are arranged at both sides of a column in which the subpixel position is located, and in the left five columns and the right five columns adjacent to the column in which the subpixel position is located, and which form a parallelogram; or three subpixels in the primitive color identical to the color of the subpixel at the subpixel position surrounding the subpixel position, which form together with the subpixel at the subpixel position a diamond; or two subpixels in the primitive color identical to the color of the subpixel at the subpixel position surrounding the subpixel position, which form together with the subpixel at the subpixel position an equilateral triangle; or two subpixels in the primitive color identical to the color of the subpixel at the subpixel position surrounding the subpixel position, which form together with the subpixel at the subpixel position an isosceles triangle.

Alternatively, when a color component of a primitive color different from a color of a subpixel at a subpixel position is desired to be displayed at the subpixel position, the plurality of subpixels in the identical primitive color in proximity to the subpixel position includes:

eight subpixels in the primitive color identical to the to-be-displayed color component surrounding the subpixel position, which form a diamond that surrounds the subpixel position or at least partially overlaps the subpixel position; or four subpixels in the primitive color identical to the to-be-displayed color component surrounding the subpixel position, which form a diamond that surrounds the subpixel position or at least partially overlaps the subpixel position; or three subpixels in the primitive color identical to the to-be-displayed color component surrounding the subpixel position, which form an equilateral triangle that at least partially overlaps the subpixel position; or three subpixels in the primitive color identical to the to-be-displayed color component surrounding the subpixel position, which form an isosceles triangle that at least partially overlaps the subpixel position.

Alternatively, when a color component of the primitive color identical to a color of a subpixel at a subpixel position is to desired to be displayed at the subpixel position, the step of causing the plurality of subpixels in the identical primitive color in proximity to the subpixel position to display together includes obtaining color subcomponents of the subpixel at the subpixel position and the plurality of subpixels in the primitive color identical to the color of the subpixel surrounding the subpixel position, through multiplying display scale coefficients corresponding to the subpixel at the subpixel position and the plurality of subpixels in the primitive color identical to the color of the subpixel surrounding the subpixel position by the color component of the primitive color to be displayed at the subpixel position. When a color component of the primitive color different from a color of a subpixel at a subpixel position is to desired to be displayed at the subpixel position, the step of causing the plurality of subpixels in the identical primitive color in proximity to the subpixel position to display together includes obtaining color subcomponents of the plurality of subpixels in the primitive color identical to the to-be-displayed color component surrounding the subpixel position, through multiplying display scale coefficients corresponding to the plurality of subpixels in the primitive color identical to the to-be-displayed color component surrounding the subpixel position by the color component of the primitive color to be displayed at the subpixel position. The display scale coefficient of each subpixel in the primitive color in proximity to the subpixel position is associated with a distance between the subpixel in the primitive color and the subpixel position.

Alternatively, when a subpixel at a subpixel position is a subpixel in a complementary color, the plurality of subpixels in the complementary color in proximity to the subpixel position includes the subpixel at the subpixel position and a plurality of subpixels in the complementary subpixels surrounding the subpixel position. When a subpixel at a subpixel position is not a subpixel in a complementary color, the plurality of subpixels in the complementary color in proximity to the subpixel position includes a plurality of subpixels in the complementary color surrounding the subpixel position.

Alternatively, when a subpixel at a subpixel position is a subpixel in a complementary color, the plurality of subpixels in the complementary color in proximity to the subpixel position includes:

eight subpixels in the complementary color in closest proximity to the subpixel position, which are arranged at both sides of a row in which the subpixel position is located, and in the upper three rows and the lower three rows adjacent to the row in which the subpixel position is located, and which form a parallelogram; or eight subpixels in the complementary color in closest proximity to the subpixel position, which are arranged at both sides of a column in which the subpixel position is located, and in the left five columns and the right five columns adjacent to the column in which the subpixel position is located, and which form a parallelogram; or three subpixels in the complementary color surrounding the subpixel position, which form together with the subpixel at the subpixel position a diamond; or two subpixels in the complementary color surrounding the subpixel position, which form together with the subpixel at the subpixel position an equilateral triangle; or two subpixels in the complementary color surrounding the subpixel position, which form together with the subpixel at the subpixel position an isosceles triangle.

Alternatively, when a subpixel at a subpixel position is not a subpixel in a complementary color, the plurality of subpixels in the complementary color surrounding the subpixel position includes:

eight subpixels in the complementary color surrounding the subpixel position, which form a diamond that surrounds the subpixel position or at least partially overlaps the subpixel position; or four subpixels in the complementary color surrounding the subpixel position, which form a diamond that surrounds the subpixel position or at least partially overlaps the subpixel position; or three subpixels in the complementary color surrounding the subpixel position, which form an equilateral triangle that at least partially overlaps the subpixel position; or three subpixels in the complementary color surrounding the subpixel position, which form an isosceles triangle that at least partially overlaps the subpixel position.

Alternatively, when a subpixel at a subpixel position is a subpixel in a complementary color, the step of performing the display compensation at the subpixel position under the average effect of the plurality of subpixels in the complementary color in proximity to the subpixel position includes obtaining complementary subcomponents of the subpixel at the subpixel position and the plurality of subpixels in the complementary color surrounding the subpixel position, through multiplying display scale coefficients corresponding to the subpixel at the subpixel position and the plurality of subpixels in the complementary color surrounding the subpixel position by the complementary component of the complementary color to be displayed at the subpixel position. When a subpixel at a subpixel position is not a subpixel in the complementary color, the step of performing the display compensation at the subpixel position under the average effect of the plurality of subpixels in the complementary color in proximity to the subpixel position includes obtaining complementary subcomponents of the plurality of subpixels in the complementary color surrounding the subpixel position, through multiplying display scale coefficients corresponding to the plurality of subpixels in the complementary color surrounding the subpixel position by the complementary component of the complementary color to be displayed at the subpixel position. The display scale coefficient of each subpixel in the complementary color in proximity to the subpixel position is associated with a distance between the subpixel in the complementary color and the subpixel position.

According to the embodiments of the present disclosure, the four subpixels of each repeating unit in the pixel structure are arranged irregularly, and all the color components may be displayed at each subpixel position. As a result, it is able to remarkably increase the visual resolution and perform the display compensation at each subpixel position without increasing the difficulty in the manufacture process, thereby to improve a display effect.

DETAILED DESCRIPTION

In order to make the objects, the technical solutions and the advantages of the present disclosure more apparent, the present disclosure will be described hereinafter in conjunction with the drawings and embodiments.

Figure 1:
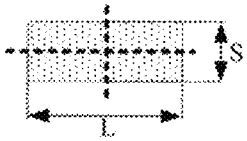
FIG. 1 is a schematic view showing a major axis and a minor axis of a subpixel according to one embodiment of the present disclosure.
Figure 2A:
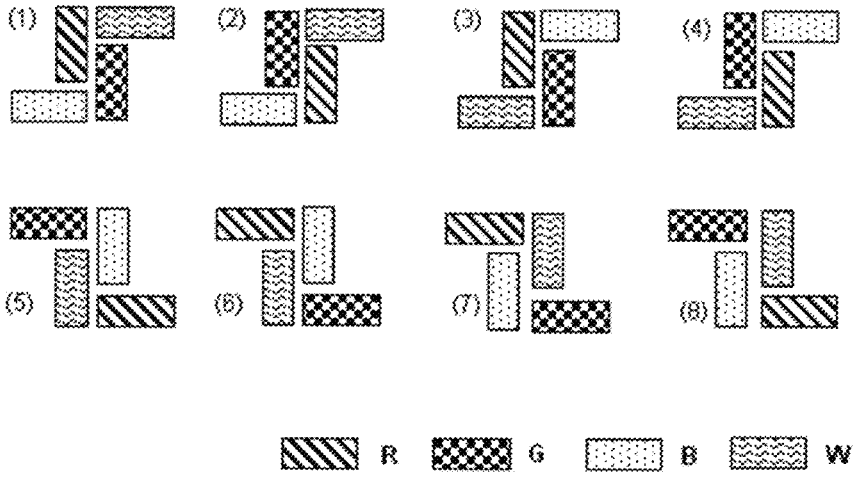
FIGS. 2A and 2B are schematic views showing arrangement modes of the subpixels in a repeating unit according to one embodiment of the present disclosure.
Figure 2B:
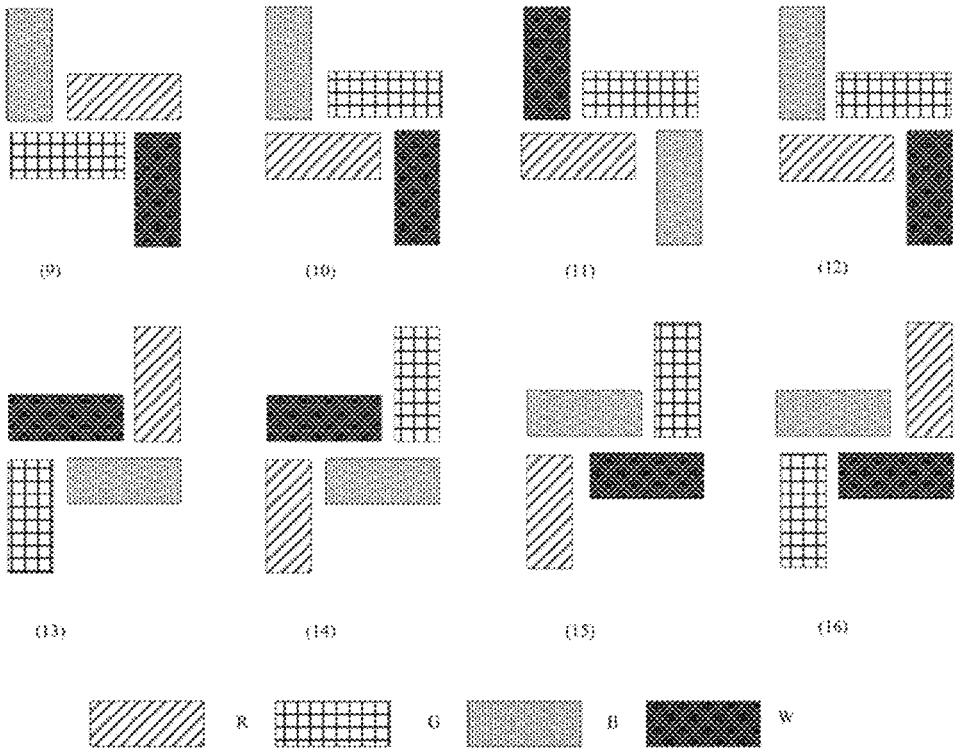
Figure 3:
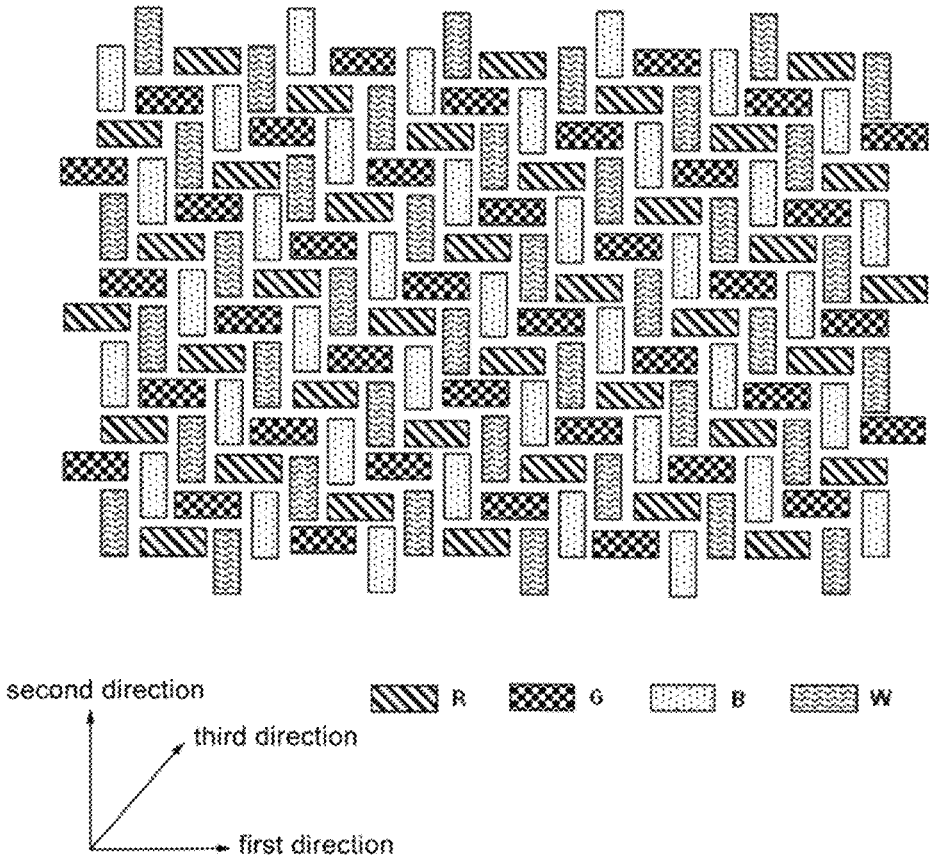
FIG. 3 is a schematic view showing an arrangement mode of the subpixels on a display panel according to one embodiment of the present disclosure.

Referring to FIGS. 1-3, the present disclosure provides in one embodiment a pixel structure, which includes a plurality of repeating units consisting of subpixels. Each repeating unit includes four subpixels in different colors, which are divided into two groups. Each group of subpixels includes a subpixel with its major-axis direction as a first direction and a subpixel with its major-axis as a second direction perpendicular to the first direction.

Four subpixels in different colors in each repeating unit may include three subpixels in primitive colors and one subpixel in a complementary color. The subpixels in the primitive colors may include red (R), green (G) and blue (B) subpixels, and the subpixel in the complementary color may include a white (W), magenta, yellow, cyan or garnet subpixel. When the subpixel in the complementary color is a white subpixel, it is able to compensate for the brightness of the entire display panel due to high transmittance of the white subpixel. When the subpixel in the complementary color is a magenta, yellow, cyan or garnet subpixel, it is able to compensate for a color range of the entire display panel.

The following embodiments are given by taking a repeating unit including R, G, B and W subpixels as an example.

Alternatively, the subpixel in the embodiments of the present disclosure is of a quadrilateral shape, and particularly a rectangular shape.

Referring to FIG. 1, which is a schematic view showing a major axis and a minor axis of the subpixel according to one embodiment of the present disclosure, the major axis L of the subpixel is perpendicular to the minor axis S, and a length of subpixel in the major-axis direction is larger than a length thereof in the minor-axis direction.

In a conventional pixel structure, the major axes of the subpixels in each pixel unit usually extend in an identical direction. However, in the pixel structure in the embodiments of the present disclosure, the four subpixels in each repeating unit are arranged irregularly and divided into two groups. Each group of subpixels includes a subpixel with its major-axis direction as the first direction and a subpixel with its major-axis direction as the second direction. Through this arrangement mode, it is able to distribute the subpixels in different colors evenly, display the color more evenly and facilitate the design of a sampling region, which will be described hereinafter, for virtual display, thereby to output an image at high quality using a low physical PPI design.

Alternatively, in the embodiments of the present disclosure, the two subpixels in each group of subpixels are each of an L shape and a mirror image of ⅃, and arranged in such a manner as to be rotated by 0°, 45°, 90°, 135° or 180° in a clockwise or counterclockwise direction. For example, one pixel is of a pattern of L, and its mirror image is ⅃. After the L shape is rotated by 0, 45°, 90°, 135° or 180° in the counterclockwise direction, such patterns as L, ↘, ⅃, ↗, and ⅂ Of course, in the other embodiments, the two subpixels in each group of subpixels are each of a T shape and arranged in such a manner as to be rotated by 0°, 45°, 90°, 135° or 180° in the clockwise or counterclockwise direction.

The arrangement modes of the subpixels in the repeating unit will be described hereinafter.

Alternatively, the first direction is a row direction, and the second direction is a column direction. In two groups of subpixels in each repeating unit, the two subpixels with their major-axis direction as the second direction are arranged in adjacent columns, and the two subpixels with their major-axis direction as the second direction are staggered relative to each other in the row direction by a predetermined distance. Referring to FIG. 2A, in each repeating unit, the two subpixels with their major-axis direction as the first direction are adjacent to the two subpixels with their major-axis direction as the second direction, and the two subpixels with their major-axis direction as the first direction are not adjacent to each other. Through this arrangement mode, it is able to ensure that the four subpixels in each repeating unit are arranged as close to each other as possible.

Alternatively, the first direction is a row direction, and the second direction is a column direction. In each repeating unit, the two subpixels with their major-axis direction as the first direction are arranged in adjacent rows, and the two subpixels with their major-axis direction as the first direction are staggered relative to each other in the column direction by a predetermined distance. Referring to FIG. 2B, in each repeating unit, the two subpixels with their major-axis direction as the second direction are adjacent to the two subpixels with their major-axis direction as the second direction, and the two subpixels with their major-axis direction as the second direction are not adjacent to each other. Through this arrangement mode, it is able to ensure that the four subpixels in each repeating unit are arranged as close to each other as possible.

Of course, apart from the arrangement modes in FIGS. 2A and 2B, the four subpixels in each repeating unit may be arranged in any other modes, which are not particularly defined herein.

Alternatively, the plurality of repeating units are arranged repeatedly in a third direction which is a direction rotated in a counterclockwise direction by 45° relative to the row direction, or a direction rotated in the counterclockwise direction by 45° relative to the column direction. Referring to FIG. 3, which shows a pixel structure where the third direction is a direction rotated in a counterclockwise direction by 45° relative to the row direction, the subpixels with their major-axis direction as the first direction are arranged sequentially in the third direction, the subpixels with their major-axis direction as the second direction are also arranged sequentially in the third direction, and the subpixels with their major-axis direction as the first direction and the subpixels with their major-axis direction as the second direction are arranged alternately in a direction perpendicular to the third direction.

Alternatively, the subpixels with their major-axis direction as the first direction include subpixels in a first color and subpixels in a second color, the subpixels with their major-axis direction as the second direction include subpixels in a third color and subpixels in a fourth color, the subpixels in the first color and the second color are arranged alternately in the third direction, and the subpixels in the third color and the fourth color are arranged alternately in the third direction. Through this arrangement mode, it is able to distribute the subpixels evenly, thereby to improve a display effect.

Figure 4:
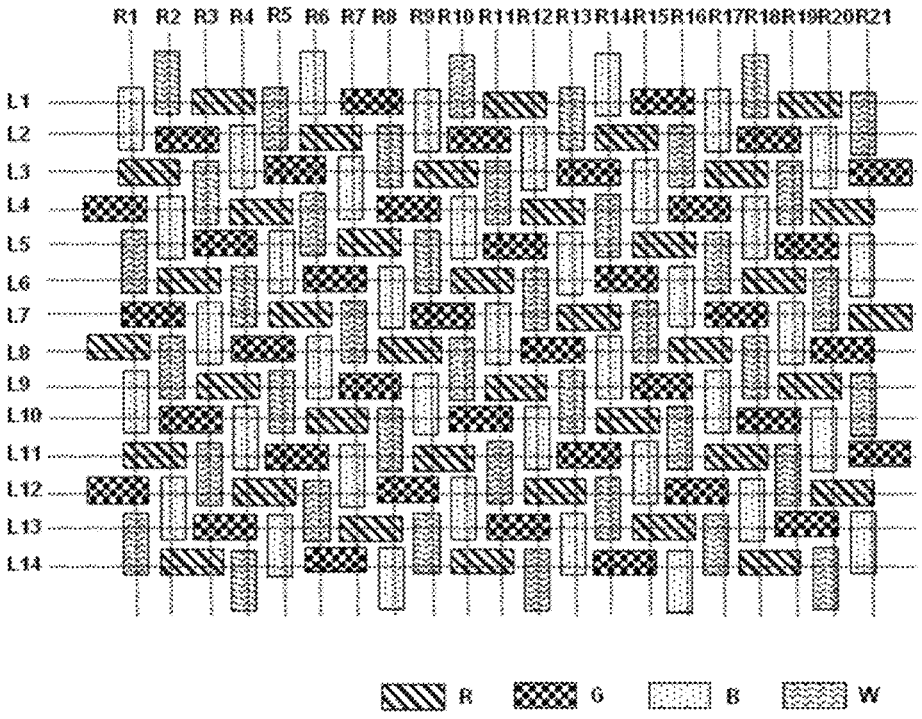
FIG. 4 is a schematic view showing position identifiers for the subpixels on the display panel in FIG. 3.

Referring to FIG. 4, which shows position identifiers for the subpixels in the pixel structure in FIG. 3, L1 represents a first row, L2 represents a second row, . . . and L14 represents a $14^{th}$ row, while R1 represents a first column, R2 represents a second column, . . . and R21 represents a $21^{st}$ column.

As shown in FIG. 4, the subpixels with their major-axis direction as the first direction (the row direction) are arranged by crossing two columns, and the subpixels with their major-axis direction as the second direction (the column direction) are arranged by crossing two rows. Alternatively, a length of each subpixel in the major-axis direction and a length of the subpixel in a minor-axis direction meet $2S<L<3S$, wherein S represents the length of the subpixel in the minor-axis direction, and L represents the length of the subpixel in the major-axis direction.

The present disclosure further provides in one embodiment a display device including the above-mentioned pixel structure and a device for driving the pixel structure.

The present disclosure further provides in one embodiment a method for driving the above-mentioned pixel structure, including steps of:

Step S51: causing a desired color component of a primitive color to be displayed at each subpixel position, i.e., causing a plurality of subpixels in an identical primitive color in proximity to the subpixel position to display together, and causing the desired color component to be displayed at the subpixel position under an average effect of the plurality of subpixels in the identical primitive color; and Step S52: performing display compensation at the subpixel position. i.e., performing the display compensation at the subpixel position under an average effect of a plurality of subpixels in a complementary color in proximity to the subpixel position.

The above two steps are required to be performed during a display procedure, and they are used to display the components of three primitive colors and perform the display compensation, respectively, so they may be performed in any order.

In the embodiments of the present disclosure, a desired content is displayed at a position where each subpixel is located (rather than by each subpixel), i.e., the desired color components of the three primitive colors are displayed simultaneously. Each color component at each subpixel position is displayed by the plurality of subpixels in the identical primitive color in proximity to the subpixel position, and the desired color component is displayed at the subpixel position under the average effect of the subpixels in the primitive colors. Meanwhile, the subpixel in the complementary color may further be used in the embodiments to perform the display compensation on the subpixel position, thereby to improve the display effect.

Of course, it should be appreciated that, because the content at each subpixel position is displayed (and compensated) by the plurality of subpixels, correspondingly, each subpixel is used for the display not only at one position and but also at a plurality of subpixel positions. In other words, for any subpixel, the content to be displayed also depends on the content to be displayed at the corresponding subpixel positions.

The driving method in the embodiments of the present disclosure has the following advantageous. At first, all the color components may be displayed at each subpixel position (e.g., the blue component may also be displayed at the R subpixel), i.e., the complete content may be displayed at each subpixel position. Each subpixel position is equivalent to one pixel, so the visual resolution is remarkably increased. Next, the display compensation may be performed at each subpixel position, so it is able to improve the display effect. In addition, the display (and also the compensation) of the content at each subpixel position is a result of the average effect of the plurality of subpixels in proximity to the subpixel position, so it is able to display the color evenly and softly, thereby to improve the display effect. Finally, the display is performed in the method of the present disclosure on the basis of each subpixel position, and the content to be displayed by the subpixels in proximity to each subpixel position is calculated correspondingly, so it is able to directly calculate the content to be displayed by each subpixel, thereby to reduce the operation burden and facilitate the implementation thereof.

Alternatively, when a color component of a primitive color identical to a color of a subpixel at a subpixel position is desired to be displayed at the subpixel position (e.g., when a red component is to be displayed at a R subpixel position), the plurality of subpixels in the identical primitive color in proximity to the subpixel position includes the subpixel (the R subpixel) at the subpixel position and a plurality of subpixels (R subpixels) in the identical primitive color surrounding the subpixel position.

When a color component of a primitive color different from a color of a subpixel at a subpixel position is desired to be displayed at the subpixel position (e.g., when a green component is to be displayed at a R subpixel position), the plurality of subpixels in the identical primitive color in proximity to the subpixel position includes a plurality of subpixels (G subpixels) in a primitive color identical to the to-be-displayed color component surrounding the subpixel position. In order words, at this time, the subpixels in the primitive color in proximity to the subpixel position do not include the subpixel at the subpixel position (because of different colors).

The subpixels in the primitive color in proximity to the subpixel position may be selected in accordance with the practical need.

The method for determining the color subcomponent of the plurality of subpixels in the identical primitive color in proximity to the subpixel position will be described hereinafter.

Alternatively, when a color component of the primitive color identical to a color of a subpixel at a subpixel position is to desired to be displayed at the subpixel position, the step of causing the plurality of subpixels in the identical primitive color in proximity to the subpixel position to display together includes obtaining color subcomponents of the subpixel at the subpixel position and the plurality of subpixels in the primitive color identical to the color of the subpixel surrounding the subpixel position, through multiplying display scale coefficients corresponding to the subpixel at the subpixel position and the plurality of subpixels in the primitive color identical to the color of the subpixel surrounding the subpixel position by the color component of the primitive color to be displayed at the subpixel position.

When a color component of the primitive color different from a color of a subpixel at a subpixel position is to desired to be displayed at the subpixel position, the step of causing the plurality of subpixels in the identical primitive color in proximity to the subpixel position to display together includes obtaining color subcomponents of the plurality of subpixels in the primitive color identical to the to-be-displayed color component surrounding the subpixel position, through multiplying display scale coefficients corresponding to the plurality of subpixels in the primitive color identical to the to-be-displayed color component surrounding the subpixel position by the color component of the primitive color to be displayed at the subpixel position.

The display scale coefficient of each subpixel in the primitive color in proximity to the subpixel position is associated with a distance between the subpixel in the primitive color and the subpixel position.

For example, when a color component in a color identical to a subpixel (e.g., a R subpixel) at a subpixel position is to be displayed at the subpixel position, a display scale coefficient (e.g., 0.76) of the R subpixel at the subpixel position is multiplied by a desired color component Y to be displayed at the subpixel position, so as to obtain the color subcomponent (0.76Y) of the R subpixel at the subpixel position; and a display scale coefficient of each of the eight R subpixels surrounding the subpixel position (e.g., a display scale coefficient of each R subpixel surrounding the subpixel position is 0.03) is multiplied by the desired color component Y to be displayed at the subpixel position, so as to obtain the color subcomponent (0.03Y) of each of the R subpixels surrounding the subpixel position.

Alternatively, when a subpixel at a subpixel position is a subpixel in a complementary color, the plurality of subpixels in the complementary color in proximity to the subpixel position includes the subpixel at the subpixel position and a plurality of subpixels in the complementary color surrounding the subpixel position. When a subpixel at a subpixel position is not a subpixel in a complementary color, the plurality of subpixels in the complementary color in proximity to the subpixel position includes a plurality of subpixels in the complementary color surrounding the subpixel position.

The method for determining the color subcomponents of the plurality of subpixels in the complementary color in proximity to the subpixel position will be described hereinafter.

Alternatively, when a subpixel at a subpixel position is a subpixel in a complementary color, the step of performing the display compensation at the subpixel position under the average effect of the plurality of subpixels in the complementary color in proximity to the subpixel position includes obtaining complementary subcomponents of the subpixel at the subpixel position and the plurality of subpixels in the complementary color surrounding the subpixel position, through multiplying display scale coefficients corresponding to the subpixel at the subpixel position and the plurality of subpixels in the complementary color surrounding the subpixel position by the complementary component of the complementary color to be displayed at the subpixel position. When a subpixel at a subpixel position is not a subpixel in the complementary color, the step of performing the display compensation at the subpixel position under the average effect of the plurality of subpixels in the complementary color in proximity to the subpixel position includes obtaining complementary subcomponents of the plurality of subpixels in the complementary color surrounding the subpixel position, through multiplying display scale coefficients corresponding to the plurality of subpixels in the complementary color surrounding the subpixel position by the complementary component of the complementary color to be displayed at the subpixel position. The display scale coefficient of each subpixel in the complementary color in proximity to the subpixel position is associated with a distance between the subpixel in the complementary color and the subpixel position.

In the embodiments of the present disclosure, a region where a plurality of subpixels surrounding the subpixel position may be called as a sampling region of the subpixel position, and the plurality of subpixels may be called as common subpixels.

The selection of the sampling region will be described hereinafter.

Alternatively, when a color component of a primitive color identical to a color of a subpixel at a subpixel position is desired to be displayed at the subpixel position, the plurality of subpixels in the identical primitive color in proximity to the subpixel position includes:

eight subpixels in the primitive color identical to the color of the subpixel at the subpixel position in closest proximity to the subpixel position, which are arranged at both sides of a row in which the subpixel position is located, and in the upper three rows and the lower three rows adjacent to the row in which the subpixel position is located, and which form a parallelogram; or eight subpixels in the primitive color identical to the color of the subpixel at the subpixel position in closest proximity to the subpixel position, which are arranged at both sides of a column in which the subpixel position is located, and in the left five columns and the right five columns adjacent to the column in which the subpixel position is located, and which form a parallelogram; or three subpixels in the primitive color identical to the color of the subpixel at the subpixel position surrounding the subpixel position, which form together with the subpixel at the subpixel position a diamond; or two subpixels in the primitive color identical to the color of the subpixel at the subpixel position surrounding the subpixel position, which form together with the subpixel at the subpixel position an equilateral triangle; or two subpixels in the primitive color identical to the color of the subpixel at the subpixel position surrounding the subpixel position, which form together with the subpixel at the subpixel position an isosceles triangle.

Alternatively, when a color component of a primitive color different from a color of a subpixel at a subpixel position is desired to be displayed at the subpixel position, the plurality of subpixels in the identical primitive color in proximity to the subpixel position includes:

eight subpixels in the primitive color identical to the to-be-displayed color component surrounding the subpixel position, which form a diamond that surrounds the subpixel position or at least partially overlaps the subpixel position; or four subpixels in the primitive color identical to the to-be-displayed color component surrounding the subpixel position, which form a diamond that surrounds the subpixel position or at least partially overlaps the subpixel position; or three subpixels in the primitive color identical to the to-be-displayed color component surrounding the subpixel position, which form an equilateral triangle that at least partially overlaps the subpixel position; or three subpixels in the primitive color identical to the to-be-displayed color component surrounding the subpixel position, which form an isosceles triangle that at least partially overlaps the subpixel position.

Alternatively, when a subpixel at a subpixel position is a subpixel in a complementary color, the plurality of subpixels in the complementary color in proximity to the subpixel position includes:

eight subpixels in the complementary color in closest proximity to the subpixel position, which are arranged at both sides of a row in which the subpixel position is located, and in the upper three rows and the lower three rows adjacent to the row in which the subpixel position is located, and which form a parallelogram; or eight subpixels in the complementary color in closest proximity to the subpixel position, which are arranged at both sides of a column in which the subpixel position is located, and in the left five columns and the right five columns adjacent to the column in which the subpixel position is located, and which form a parallelogram; or three subpixels in the complementary color surrounding the subpixel position, which form together with the subpixel at the subpixel position a diamond; or two subpixels in the complementary color surrounding the subpixel position, which form together with the subpixel at the subpixel position an equilateral triangle; or two subpixels in the complementary color surrounding the subpixel position, which form together with the subpixel at the subpixel position an isosceles triangle.

Alternatively, when a subpixel at a subpixel position is not a subpixel in a complementary color, the plurality of subpixels in the complementary color surrounding the subpixel position includes:

eight subpixels in the complementary color surrounding the subpixel position, which form a diamond that surrounds the subpixel position or at least partially overlaps the subpixel position; or four subpixels in the complementary color surrounding the subpixel position, which form a diamond that surrounds the subpixel position or at least partially overlaps the subpixel position; or three subpixels in the complementary color surrounding the subpixel position, which form an equilateral triangle that at least partially overlaps the subpixel position; or three subpixels in the complementary color surrounding the subpixel position, which form an isosceles triangle that at least partially overlaps the subpixel position.

Figure 5:
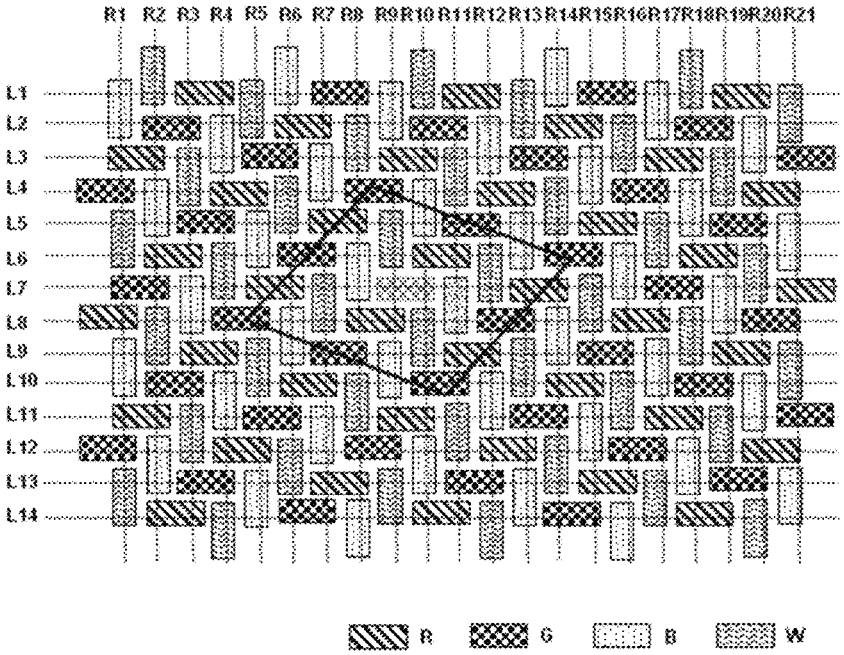
FIG. 5 is a schematic view showing a sampling region for green subpixels in the repeating unit according to the first embodiment of the present disclosure.

Referring to FIG. 5, which shows a sampling region for a green subpixel in the repeating unit according to the first embodiment of the present disclosure, a green component is displayed at the green subpixel R10L7 position, and the green subpixels in proximity to the green subpixel position include eight green subpixels (R9L4, R7L6, R5L8, R8L9, R11L10, R13L8, R15L6 and R12L5) in closest proximity to the green subpixel R10L7, which are arranged at both sides of the row where the green subpixel R10L7 is located, in up and down three rows closest to the row where the green subpixel R10L7 is located. These eight green subpixels are also called as common subpixels, which form a diamond sampling region surrounding the green subpixel. The eight common green subpixels in this sampling region, together with the green subpixel R10L7, output a signal at a position where the green subpixel R10L7 is located. This quadrilateral sampling region including eight common subpixels is of a large common region, so it is able to display a continuous image in a better manner.

Figure 6:
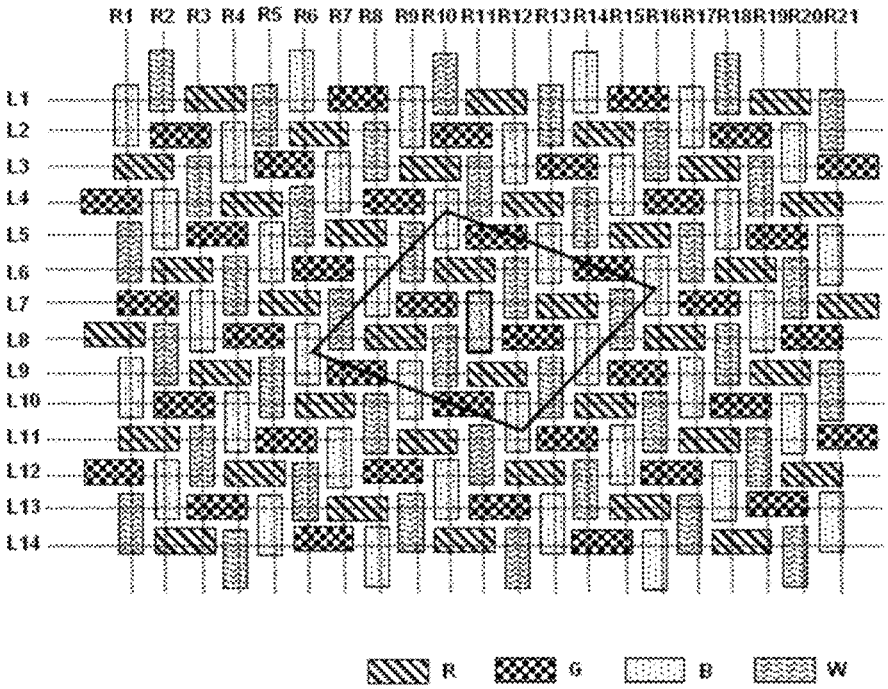
FIG. 6 is a schematic view showing a sampling region for blue subpixels in the repeating unit according to the first embodiment of the present disclosure.
Figure 8:
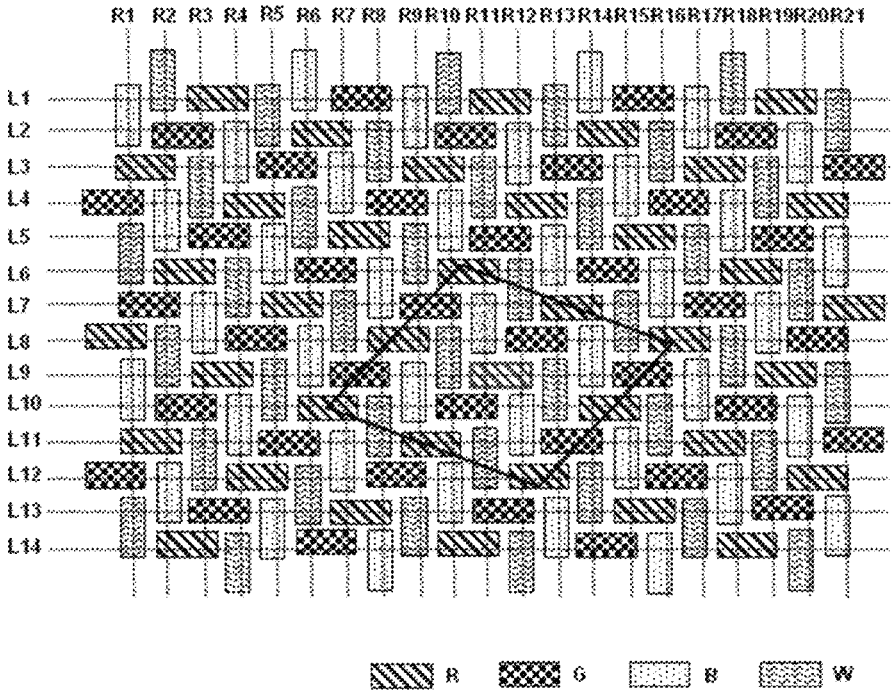
FIG. 8 is a schematic view showing a sampling region for red subpixels in the repeating unit according to the first embodiment of the present disclosure.

FIGS. 6 and 8 show the conditions where a color component in a primitive color identical to a color of a subpixel at a subpixel position is to be displayed at the subpixel position. To be specific, FIG. 6 shows a sampling region for a blue subpixel in the repeating unit according to the first embodiment of the present disclosure, and FIG. 8 shows a sampling region for a red subpixel in the repeating unit according to the first embodiment of the present disclosure. Similar to the green subpixel R10L7 in FIG. 5, sampling regions for a blue subpixel R11L8 and a red subpixel R9L8 each include eight common subpixels.

Of course, when a color component in a primitive color different from a color of a subpixel at a subpixel position is to be displayed at the subpixel position, the sampling regions in FIGS. 5, 6 and 8 may also be used. For example, a green component may also be displayed at a white subpixel R8L6 position in the sampling region in FIG. 5, and the eight green subpixels in the sampling region in FIG. 5 may be used as common subpixels.

Figure 7:
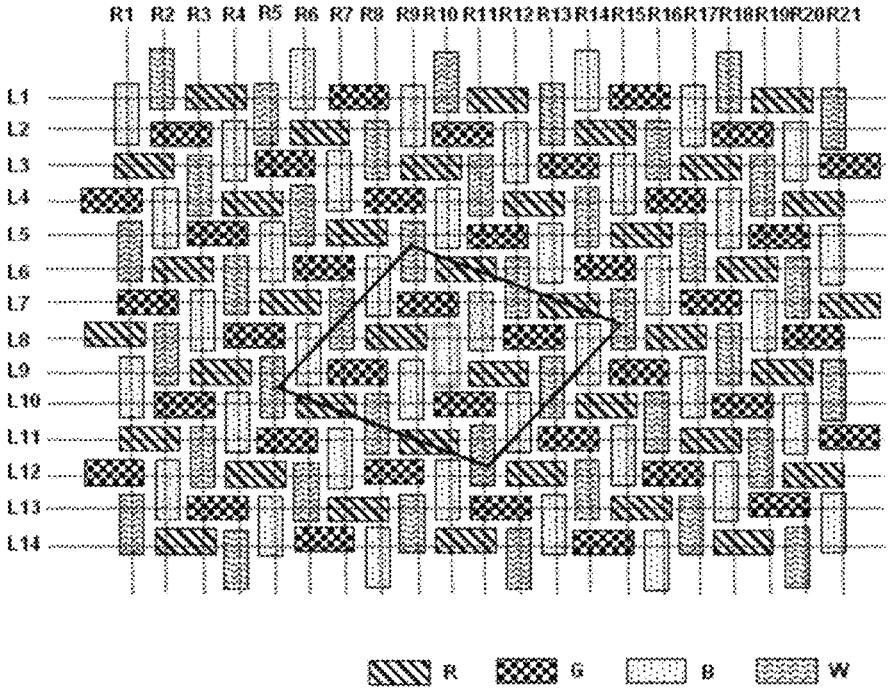
FIG. 7 is a schematic view showing a sampling region for white subpixels in the repeating unit according to the first embodiment of the present disclosure.

FIG. 7 is a schematic view showing a sampling region for a white subpixel in the repeating unit according to the first embodiment of the present disclosure. In this embodiment, a white component is displayed at a white subpixel R10L8 position, and the plurality of subpixels in the complementary color in proximity to the white subpixel position includes eight white subpixels in closest proximity to the white subpixel R10L8, which are arranged at both sides of a column where the white subpixel R10L8 is located, and in left and right five columns closest to the column where the white subpixel R10L8 is located. These eight white subpixels may also be called as common subpixels, which form a diamond sampling region surrounding the white subpixel R10L8.

Of course, when a subpixel at a subpixel position is not a white subpixel, the plurality of subpixels in the complementary color in proximity to the white subpixel position may also include the white subpixels in the sampling region in FIG. 7. For example, at a red subpixel R8L8 position in the sampling region in FIG. 7, the white subpixels in the sampling region in FIG. 7 may also be used as the complementary subpixels.

In the other embodiments of the present disclosure, the sampling region for the subpixels may be of any other shapes, which will be described hereinafter.

Figure 9:
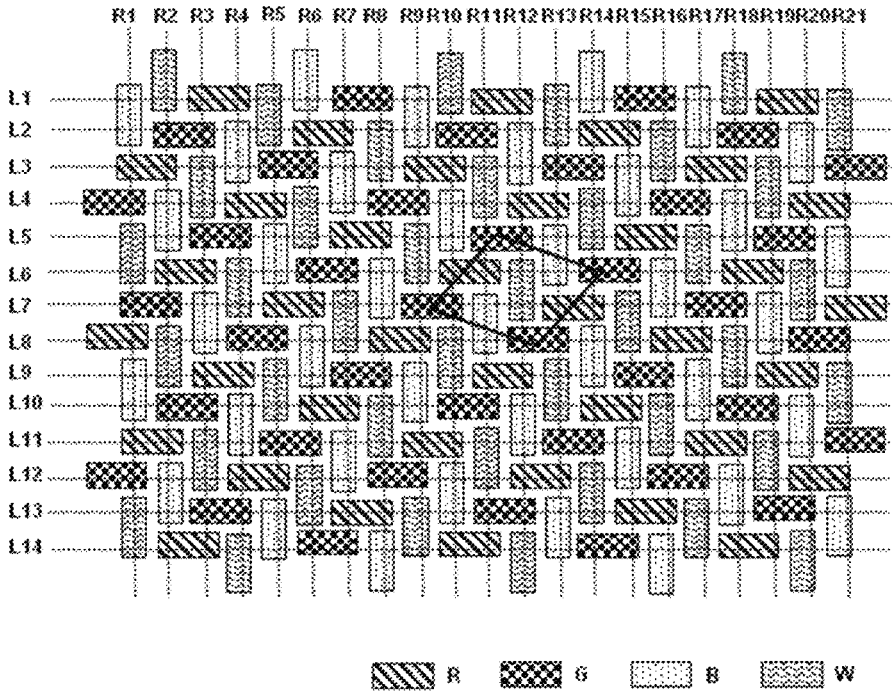
FIG. 9 is a schematic view showing a sampling region for green subpixels in the repeating unit according to the second embodiment of the present disclosure.

Referring to FIG. 9, which is a schematic view showing a sampling region for a green subpixel in the repeating unit according to the second embodiment of the present disclosure, a green component is displayed at the white subpixel R10L7 position, and the green subpixels in proximity to the green subpixel position include three green subpixels (R13L8, R15L6 and R12L5) surrounding the green subpixel position. The green subpixel R10L7 forms together with the three green subpixels (R13L8, R15L6 and R12L5) a diamond. The green subpixels in this sampling region output a signal at a position where the green subpixel R10L7 is located. The quadrilateral sampling region including three common subpixels is of a small area, so it is able to determine a virtual position accurately.

Figure 10:
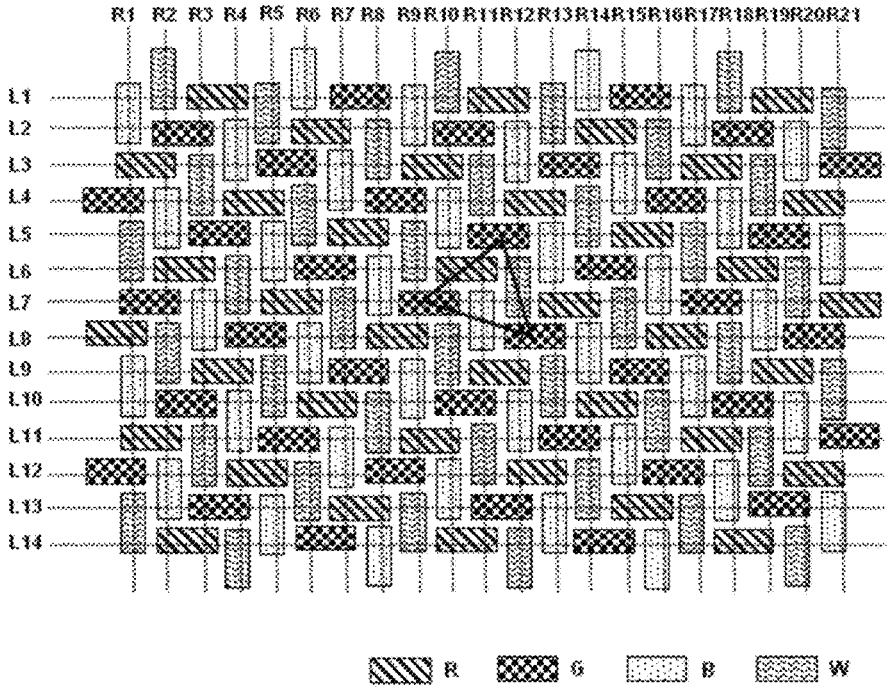
FIG. 10 is a schematic view showing a sampling region for green subpixels in the repeating unit according to the third embodiment of the present disclosure.

Referring to FIG. 10, which is a schematic view showing a sampling region for a green subpixel in the repeating unit according to the third embodiment of the present disclosure, a green component is displayed at the green subpixel R10L7 position, and the green subpixels in proximity to the green subpixel position include two green subpixels (R13L8 and R12L5) surrounding the green subpixel position. The green subpixel R10L7 forms together with the two green subpixels (R13L8 and R12L5) an equilateral triangle, and all the green subpixels in the sampling region output a signal at a position where the green subpixel R10L7 is located. The triangular sampling region including two common subpixels is of a very small area, so it is able to perform the sampling at a boundary, thereby to provide an image with a fine edge.

Figure 11:
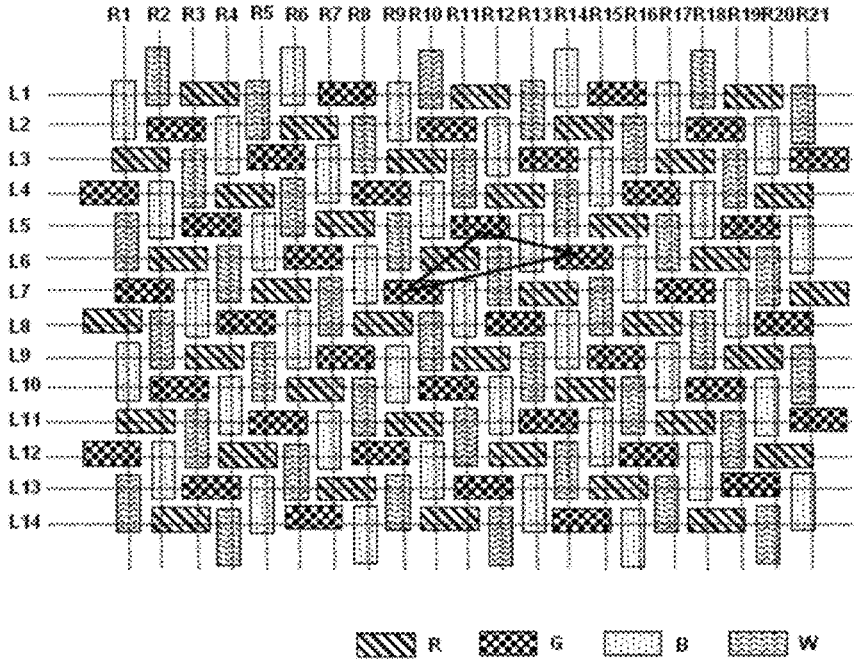
FIG. 11 is a schematic view showing a sampling region for green subpixels in the repeating unit according to the fourth embodiment of the present disclosure.

Referring to FIG. 11, which is a schematic view showing a sampling region for a green subpixel in the repeating unit according to the fourth embodiment of the present disclosure, a green component is displayed at the green subpixel R10L7 position, and the green subpixels in proximity to the green subpixel position include two green subpixels (R12L5 and R15L6) surrounding the green subpixel position. The green subpixel R10L7 forms together with the two green subpixels (R12L5 and R15L6) an isosceles triangle. All the green subpixels in the sampling region output a signal at a position where the green subpixel R10L7 is located. Identically, the triangular sampling region including two common subpixels is of a very small area, so it is able to perform the sampling at a boundary, thereby to provide an image with a fine edge.

Identically, the sampling regions in FIGS. 9-11 may also be used for the conditions where a color component in a primitive color different from a color of a subpixel at a subpixel position is to be displayed at the subpixel position, and for the selection of the sampling regions of the subpixels in the complementary color.

The sampling regions in the above embodiments are each of a regular shape, and of course, in the other embodiment, the sampling regions may each be of any other shape, e.g., an irregular shape, which are not particularly defined herein.

Of course, the selection of the sampling region is not limited to the above. During the actual display, the sampling region including the subpixels which may perform the display in a most convenient manner and which do not cause an oversized operation burden may be selected in accordance with the practical need. During the selection of a sampling region, the more the subpixels included in the sampling region and the more evenly the subpixels are distributed, the better the display effect and the greater the operation burden. In contrast, the fewer the subpixels included in the sampling region, the less the operation burden and the worse the display effect. In addition, different colors are desired to be displayed at each subpixel position, so it is required to select the sampling region in such a manner as to display an image continuously. Usually, the sampling region of a regular shape, e.g., a diamond, a parallelogram or a triangle, may be selected.

For the subpixel positions at an edge portion of the entire pixel structure, the situation is different during the selection of the sampling region as compared with the subpixel position at the center of the entire pixel structure. When it is impossible to form a complete sampling region, it is required to modify an edge of image by other edge modification methods during the display, which is not particularly defined herein.

Of course, in the embodiments of the present disclosure, the signal may be outputted by the subpixels in the sampling region through any other methods, which are not particularly defined herein.

In the embodiments of the present disclosure, apart from the shape of the sampling region, the arrangement mode of the four subpixels in the repeating unit may also adversely affect the image display effect.

Figure 12:
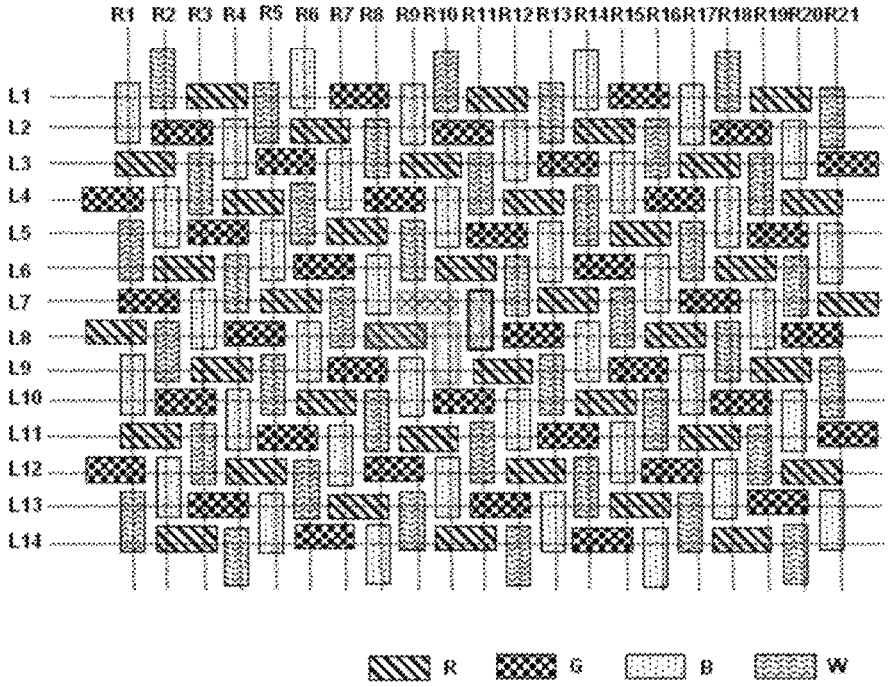
FIG. 12 is a schematic view showing an arrangement mode of four subpixels in the repeating unit according to one embodiment of the present disclosure.
Figure 13:
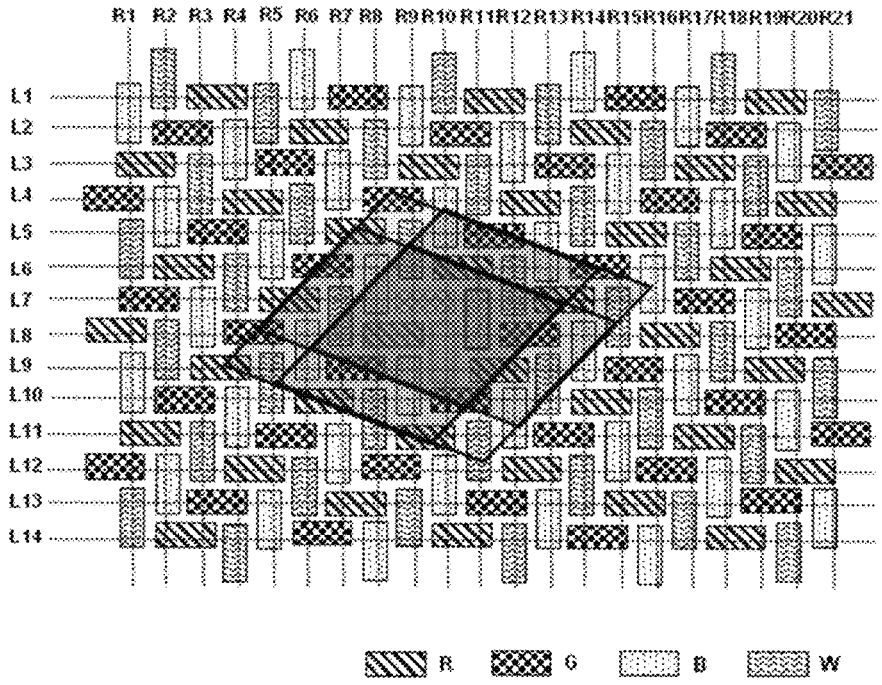
FIG. 13 is a schematic view showing a condition where sampling regions for the four subpixels in the repeating unit in FIG. 12 overlap each other.

FIG. 12 is a schematic view showing an arrangement mode of the four subpixels in the repeating unit according to one embodiment of the present disclosure, and FIG. 13 is a schematic view showing a situation where the sampling regions for the four subpixels in the repeating unit in FIG. 12 overlap each other. As shown in FIG. 13, overlapping regions between the sampling region for the subpixel in one color and the sampling regions for the subpixels in the other three colors are the same. Through this arrangement mode, within a very small display region, it is able for the sampling regions for the four subpixels to output a color image. The image displayed in this subpixel output mode has a relatively even color, so it is a preferred output mode.

Figure 14:
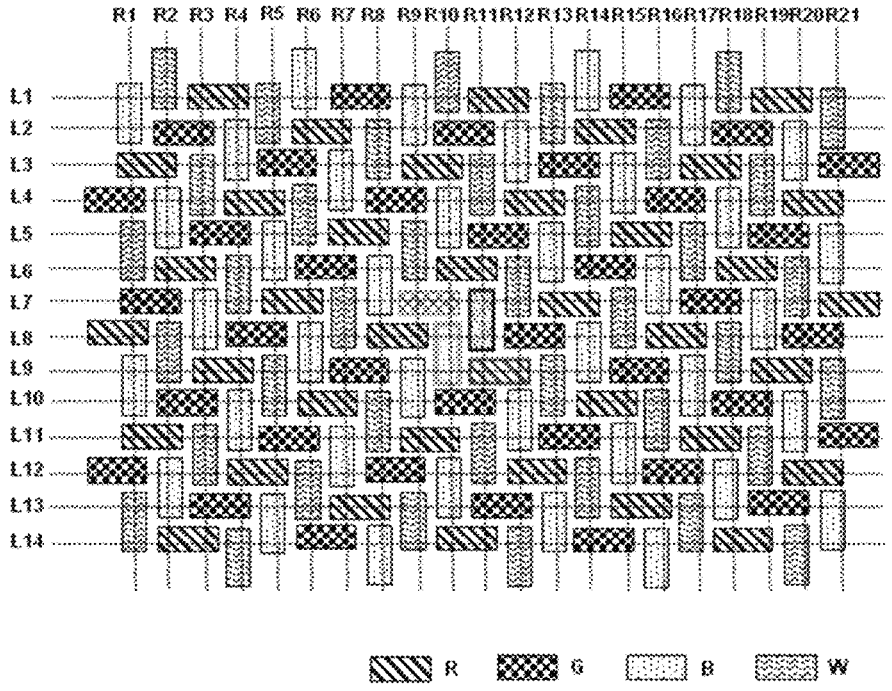
FIG. 14 is another schematic view showing an arrangement mode of the four subpixels in the repeating unit according to one embodiment of the present disclosure.
Figure 15:
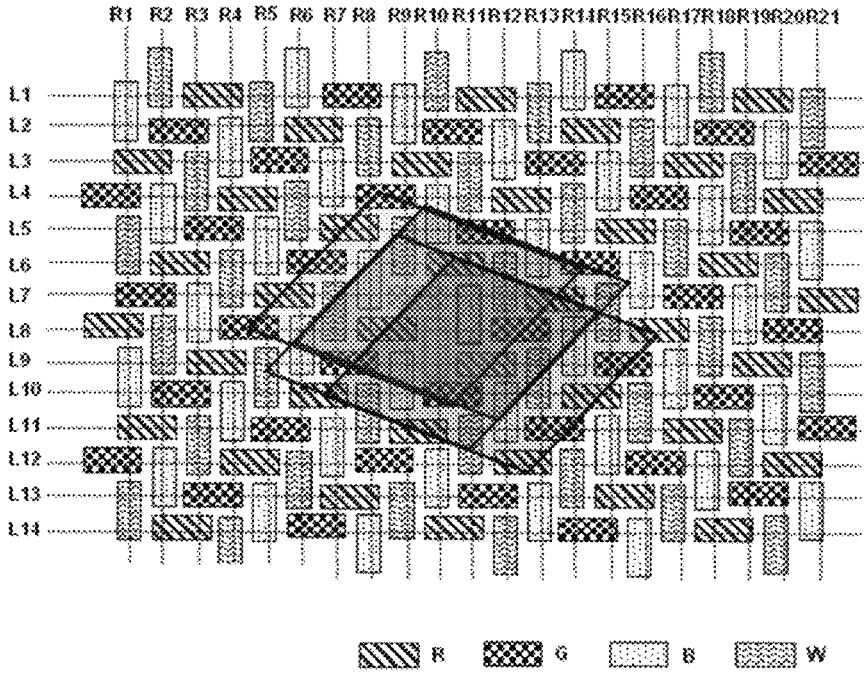
FIG. 15 is a schematic view showing a condition where sampling regions for the four subpixels in the repeating unit in FIG. 14 overlap each other.

FIG. 14 is another schematic view showing an arrangement mode of the four subpixels in the repeating unit according to one embodiment of the present disclosure, and FIG. 15 is a schematic view showing a situation where the sampling regions for the four subpixels in the repeating unit in FIG. 14 overlap each other. As shown in FIG. 15, an overlapping region between the sampling regions for the four subpixels is of a smaller area, as compared with the subpixel output mode in FIG. 13.

Figure 16:
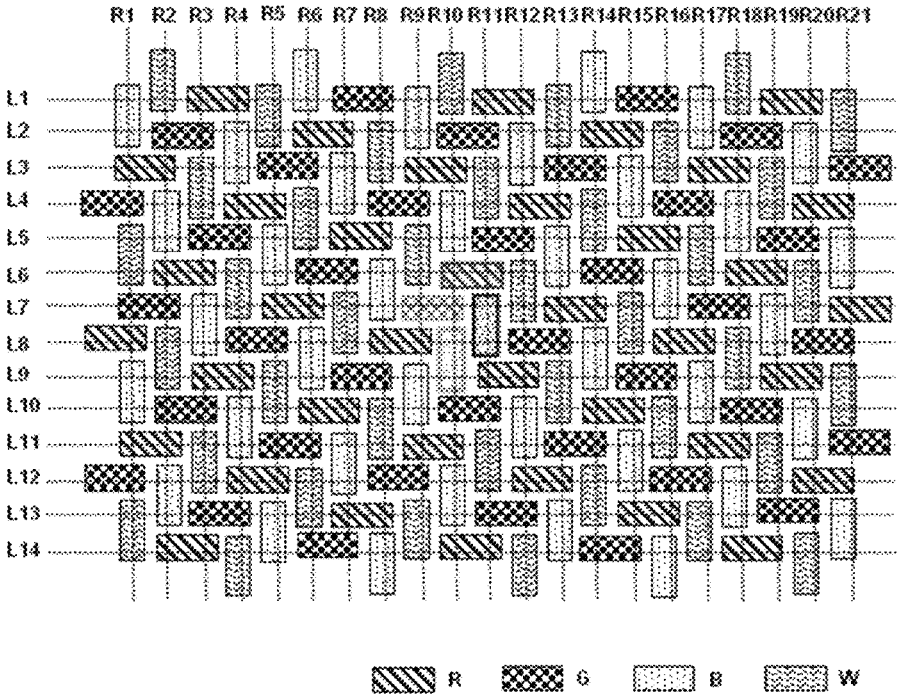
FIG. 16 is yet another schematic view showing an arrangement mode of the four subpixels in the repeating unit according to one embodiment of the present disclosure.
Figure 17:
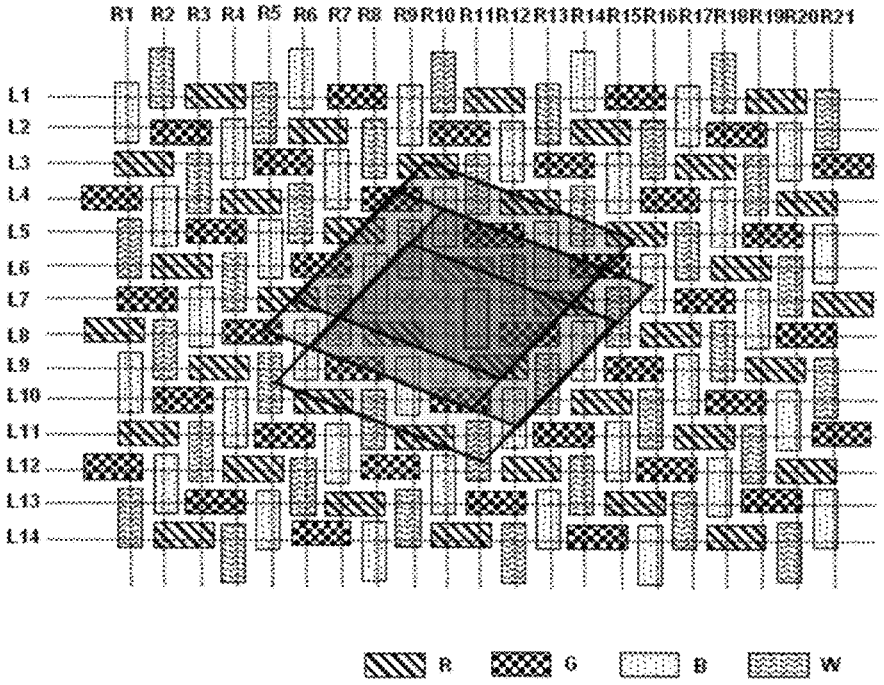
FIG. 17 is a schematic view showing a condition where the four subpixels in the repeating unit in FIG. 16 overlap each other.

FIG. 16 is yet another schematic view showing an arrangement mode of the four subpixels in the repeating unit according to one embodiment of the present disclosure, and FIG. 17 is a schematic view showing a situation where the sampling regions for the four subpixels in the repeating unit in FIG. 16 overlap each other. As shown in FIG. 16, an overlapping region between the sampling regions for the four subpixels is of a smaller area, as compared with the subpixel output mode in FIG. 13.

The display panel in the embodiments of the present disclosure may be an organic light-emitting diode (OLED) display panel, and each subpixel includes an OLED (a light-emitting unit). The OLEDs may emit light in different colors (through different organic light-emitting layers), and the color of the light emitted by each OLED is identical to the color of the subpixel including the OLED. For example, the OLED included in a red subpixel emits a red light beam.

The display panel may also be a liquid crystal display (LCD). The LCD itself does not emit light, and it filters light from a backlight source so as to display an image. The subpixels include color filter films in different colors, and a light beam passing through the color filter film may have a corresponding color. The color of the color filter film included in each subpixel is identical to the color of the subpixel. For example, the color filter film included in a red subpixel is in red.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel structure, comprising a plurality of repeating units, wherein each repeating unit consists of four subpixels in four different colors, the four subpixels are divided into two groups, and each group of subpixels comprises a subpixel with its major-axis direction as a first direction and a subpixel with its major-axis direction as a second direction perpendicular to the first direction, each of the subpixels with their major-axis directions as the first direction is adjacent to one of the subpixels with their major-axis directions as the second direction in the first direction and is adjacent to a remaining subpixel of the subpixels with their major-axis directions as the second direction in the second direction, and the subpixels with their major-axis directions as the first direction partially overlap in the second direction, and the plurality of repeating units are arranged such that the subpixels that overlap a line where a major-axis of any of the subpixels is located includes the four different colors;

wherein in each repeating unit, the two subpixels with their major-axis directions as the first direction define a first step structure and a second step structure on opposite sides of the two subpixels with their major-axis directions as the first direction along the first direction, wherein in each repeating unit, each of the two subpixels with their major-axis directions as the second direction has a first portion and a second portion extending from the first portion;

wherein the first portion of one of the two subpixels with their major-axis directions as the second direction is in the first step structure, and the second portion of the one of the two subpixels with their major-axis directions as the second direction is outside of the first step structure;

wherein the first portion of the other one of the two subpixels with their major-axis directions as the second direction is in the second step structure, and the second portion of the other one of the two subpixels with their major-axis directions as the second direction is outside of the second step structure.

2. The pixel structure according to claim 1, wherein the first direction is a row direction, and the second direction is a column direction.

3. The pixel structure according to claim 1, wherein the two subpixels in each group of subpixels are each of an L shape and a mirror image of L and arranged in such a manner as to be rotated by 0°, 45°, 90°, 135° or 180° in a clockwise or counterclockwise direction.

4. The pixel structure according to claim 2, wherein in each repeating unit, the two subpixels with their major-axis direction as the first direction are arranged in adjacent rows, and the two subpixels with their major-axis direction as the first direction are staggered relative to each other in the column direction by a predetermined distance.

5. The pixel structure according to claim 4, wherein in each repeating unit, the two subpixels with their major-axis direction as the second direction are adjacent to the two subpixels with their major-axis direction as the first direction, and the two subpixels with their major-axis direction as the second direction are not adjacent to each other.

6. The pixel structure according to claim 2, wherein in the two groups of subpixels in each repeating unit, the two subpixels with their major-axis direction as the second direction are arranged in adjacent columns, and the two subpixels with their major-axis direction as the second direction are staggered relative to each other in the row direction by a predetermined distance.

7. The pixel structure according to claim 6, wherein in each repeating unit, the two subpixels with their major-axis direction as the first direction are adjacent to the two subpixels with their major-axis direction as the second direction, and the two subpixels with their major-axis direction as the first direction are not adjacent to each other.

8. The pixel structure according to claim 1, wherein a length of each subpixel in the major-axis direction and a length of the subpixel in a minor-axis direction meet $2S<L<3S$, wherein S represents the length of the subpixel in the minor-axis direction, and L represents the length of the subpixel in the major-axis direction.

9. The pixel structure according to claim 2, wherein the plurality of repeating units are arranged repeatedly in a third direction which is a direction rotated in a counterclockwise direction by 45° relative to the row direction, or a direction rotated in the counterclockwise direction by 45° relative to the column direction.

10. The pixel structure according to claim 9, wherein the subpixels with their major-axis direction as the first direction are arranged sequentially in the third direction, and the subpixels with their major-axis direction as the second direction are also arranged sequentially in the third direction.

11. The pixel structure according to claim 9, wherein the subpixels with their major-axis direction as the first direction comprise subpixels in a first color and subpixels in a second color, the subpixels with their major-axis direction as the second direction comprise subpixels in a third color and subpixels in a fourth color, the subpixels in the first color and the second color are arranged alternately in the third direction, and the subpixels in the third color and the fourth color are arranged alternately in the third direction.

12. The pixel structure according to claim 1, wherein the subpixels in four different colors comprise three subpixels in primitive colors and one subpixel in a complementary color, the subpixels in the primitive colors comprise a red subpixel, a green subpixel and a blue subpixel, and the subpixel in the complementary color comprises a white subpixel, a magenta subpixel, a cyan subpixel, a yellow subpixel or a garnet subpixel.

13. A display device comprising the pixel structure according to claim 1, and a device for driving the pixel structure.

14. A method for driving the pixel structure according to claim 1, comprising:

driving a plurality of the subpixels having a primitive color to display together to display the primitive color at a subpixel position; and performing display compensation at the subpixel position by driving a plurality of the subpixels having a complementary color to display together to display the complementary color at the subpixel position.

15. The method according to claim 14, wherein when the primitive color is identical to a color of a subpixel at the subpixel position, the plurality of subpixels in the primitive color comprises the subpixel at the subpixel position and a plurality of subpixels having the primitive color surrounding the subpixel position; and when the primitive color is different from the color of the subpixel at the subpixel position, the plurality of subpixels having the primitive color comprises a plurality of subpixels having the primitive color surrounding the subpixel position.

16. The method according to claim 15, wherein when the primitive color is identical to the color of the subpixel at the subpixel position, the plurality of subpixels having the primitive color surrounding the subpixel position comprises:

eight subpixels having the primitive color in closest proximity to the subpixel position, which are arranged at both sides of a row in which the subpixel position is located, and in the upper three rows and the lower three rows adjacent to the row in which the subpixel position is located, and which form a parallelogram; or eight subpixels having the primitive color in closest proximity to the subpixel position, which are arranged at both sides of a column in which the subpixel position is located, and in the left five columns and the right five columns adjacent to the column in which the subpixel position is located, and which form a parallelogram; or three subpixels having the primitive color surrounding the subpixel position, which form together with the subpixel at the subpixel position a diamond; or two subpixels having the primitive color surrounding the subpixel position, which form together with the subpixel at the subpixel position an equilateral triangle; or two subpixels having the primitive color surrounding the subpixel position, which form together with the subpixel at the subpixel position an isosceles triangle.

17. The method according to claim 15, wherein when the primitive color is different from the color of the subpixel at the subpixel position, the plurality of subpixels having the primitive color surrounding the subpixel position comprises:

eight subpixels having the primitive color surrounding the subpixel position, which form a diamond that surrounds the subpixel position or at least partially overlaps the subpixel position; or four subpixels having the primitive color surrounding the subpixel position, which form a diamond that surrounds the subpixel position or at least partially overlaps the subpixel position; or three subpixels having the primitive color surrounding the subpixel position, which form an equilateral triangle that at least partially overlaps the subpixel position; or three subpixels having the primitive color surrounding the subpixel position, which form an isosceles triangle that at least partially overlaps the subpixel position.

18. The method according to claim 15, wherein when the primitive color is identical to the color of the subpixel at the subpixel position, the driving a plurality of subpixels having the primitive color to display together to display the primitive color at a subpixel position comprises obtaining color subcomponents of the subpixel at the subpixel position and the plurality of subpixels having the primitive color surrounding the subpixel position, by multiplying display scale coefficients of the subpixel at the subpixel position and the plurality of subpixels having the primitive color surrounding the subpixel position by a color component of the primitive color displayed at the subpixel position; and when the primitive color is different from the color of the subpixel at the subpixel position, the driving a plurality of subpixels having the primitive color to display together to display the primitive color at a subpixel position comprises obtaining color subcomponents of the plurality of subpixels having the primitive color surrounding the subpixel position, by multiplying display scale coefficients corresponding to the plurality of subpixels having the primitive color surrounding the subpixel position by the color component of the primitive color displayed at the subpixel position, wherein the display scale coefficient of each of the plurality of subpixels having the primitive color depends on a distance between the subpixel having the primitive color and the subpixel position.

19. The method according to claim 14, wherein when a subpixel at the subpixel position is a subpixel having the complementary color, the plurality of subpixels in the complementary color comprises the subpixel at the subpixel position and a plurality of subpixels in the complementary subpixels surrounding the subpixel position; and when the subpixel at the subpixel position is not a subpixel having the complementary color, the plurality of subpixels having the complementary color comprises a plurality of subpixels having the complementary color surrounding the subpixel position.

20. The method according to claim 19, wherein when the subpixel at the subpixel position is the subpixel having the complementary color, the plurality of subpixels having the complementary color surrounding the subpixel position comprises:

eight subpixels having the complementary color in closest proximity to the subpixel position, which are arranged at both sides of a row in which the subpixel position is located, and in the upper three rows and the lower three rows adjacent to the row in which the subpixel position is located, and which form a parallelogram; or eight subpixels having the complementary color in closest proximity to the subpixel position, which are arranged at both sides of a column in which the subpixel position is located, and in the left five columns and the right five columns adjacent to the column in which the subpixel position is located, and which form a parallelogram; or three subpixels having the complementary color surrounding the subpixel position, which form together with the subpixel at the subpixel position a diamond; or two subpixels having the complementary color surrounding the subpixel position, which form together with the subpixel at the subpixel position an equilateral triangle; or two subpixels having the complementary color surrounding the subpixel position, which form together with the subpixel at the subpixel position an isosceles triangle.

21. The method according to claim 19, wherein when the subpixel at the subpixel position is not the subpixel having the complementary color, the plurality of subpixels having the complementary color surrounding the subpixel position comprises:

eight subpixels having the complementary color surrounding the subpixel position, which form a diamond that surrounds the subpixel position or at least partially overlaps the subpixel position; or four subpixels having the complementary color surrounding the subpixel position, which form a diamond that surrounds the subpixel position or at least partially overlaps the subpixel position; or three subpixels having the complementary color surrounding the subpixel position, which form an equilateral triangle that at least partially overlaps the subpixel position; or three subpixels having the complementary color surrounding the subpixel position, which form an isosceles triangle that at least partially overlaps the subpixel position.

22. The method according to claim 19, wherein when the subpixel at the subpixel position is the subpixel having the complementary color, the performing display compensation at the subpixel position by driving a plurality of subpixels having the complementary color to display together to display the complementary color at the subpixel position comprises obtaining complementary subcomponents of the subpixel at the subpixel position and the plurality of subpixels having the complementary color surrounding the subpixel position, by multiplying display scale coefficients of the subpixel at the subpixel position and the plurality of subpixels having the complementary color surrounding the subpixel position by a complementary component of the complementary color displayed at the subpixel position; and when the subpixel at the subpixel position is not the subpixel having the complementary color, the driving a plurality of subpixels in the complementary color to display together to perform display compensation at the subpixel position comprises obtaining complementary subcomponents of the plurality of subpixels having the complementary color surrounding the subpixel position, by multiplying display scale coefficients of the plurality of subpixels having the complementary color surrounding the subpixel position by the complementary component of the complementary color displayed at the subpixel position, wherein the display scale coefficient of each of the plurality of subpixels having the complementary color depends on a distance between the subpixel having the complementary color and the subpixel position.

23. The pixel structure according to claim 1, wherein in each repeating unit, the first portion of each of the subpixels with their major-axis directions as the second direction faces all of the subpixels with their major-axis directions as the first direction;

wherein in each repeating unit, all of the subpixels with their major-axis directions as the first direction and all of the first portions together define a first rectangle, and all of the second portions define two second rectangles that are at two diagonal corners of the first rectangle, respectively.

* * * * *